US007658597B2

(12) United States Patent
Rocchi et al.

(10) Patent No.: US 7,658,597 B2
(45) Date of Patent: Feb. 9, 2010

(54) PUMP BODY WITH PLUNGER PISTONS

(75) Inventors: Alberto Rocchi, Castelfranco Emilia (IT); Stefano Reverberi, Modena (IT)

(73) Assignee: Annovi Reverberi S.p.A., Modena (IT)

( * ) Notice: Subject to any disclaimer, the term of this patent is extended or adjusted under 35 U.S.C. 154(b) by 467 days.

(21) Appl. No.: 11/180,633

(22) Filed: Jul. 14, 2005

(65) Prior Publication Data

US 2006/0024173 A1 Feb. 2, 2006

(30) Foreign Application Priority Data

Aug. 2, 2004 (IT) ..... RE20040015 U

(51) Int. Cl.
*F04B 1/12* (2006.01)
*F04B 35/01* (2006.01)
*F01B 3/02* (2006.01)

(52) U.S. Cl. ..... 417/269; 417/360; 92/71

(58) Field of Classification Search ..... 417/360; 92/71

See application file for complete search history.

(56) References Cited

U.S. PATENT DOCUMENTS 1,467,233 A 9/1923 Crumb
1,777,852 A 10/1930 Lawrence
2,142,834 A 1/1939 Bergstrom
2,250,306 A 7/1941 LaBour
2,381,056 A * 8/1945 Huber ..... 417/269
2,849,958 A 9/1958 Mitchell
2,977,891 A 4/1961 Bishop
3,070,031 A 12/1962 Puryear
3,415,160 A 12/1968 Stein et al.
3,458,114 A 7/1969 Catterson
3,586,238 A 6/1971 Schmierer
3,791,766 A 2/1974 Kikutsugi et al.
3,847,504 A 11/1974 Martin
3,949,567 A 4/1976 Stech
3,961,562 A 6/1976 Kersten et al.
4,005,948 A 2/1977 Hiraga et al.
4,019,704 A 4/1977 Levine
4,028,010 A 6/1977 Hopkins
4,033,641 A 7/1977 Cain et al.
4,195,970 A 4/1980 Zalis
4,211,519 A 7/1980 Hogah
4,226,574 A 10/1980 Villette
4,230,438 A 10/1980 Lehmann et al.
4,268,096 A 5/1981 Cain et al.
4,272,224 A 6/1981 Kabele (Continued)

FOREIGN PATENT DOCUMENTS

CA 2100762 A1 5/1993

(Continued)

OTHER PUBLICATIONS

Operating Instructions, Kaercher Brochure dated Feb. 1993.

(Continued)

*Primary Examiner*—Devon C Kramer
*Assistant Examiner*—Philip Stimpert
(74) *Attorney, Agent, or Firm*—Browdy and Neimark, PLLC

(57) ABSTRACT

Pump with plunger pistons comprising a head (1) in which are formed the intake and delivery ducts (2, 3) and the respective intake and delivery valves, a pump body (4) associated with said head (1) in which drive means (8) of at least one piston (6), and attachment and support means (5) of said pump body (4) at a body of the drive motor are situated, where said pump body (4) has, on the bottom wall (40), the seats (41) for the sliding of the pistons (6) and directly carries said attachment and support means (5) of the body of the drive motor and it is completely open on the edge facing towards the motor.

7 Claims, 1 Drawing Sheet

U.S. PATENT DOCUMENTS

| | | | | |
|---|---|---|---|---|
| 4,307,857 | A | | 12/1981 | Godbersen |
| 4,392,794 | A | | 7/1983 | Foxcroft |
| 4,490,093 | A | * | 12/1984 | Chertok et al. ..... 416/26 |
| 4,538,967 | A | | 9/1985 | Furukawa |
| 4,611,529 | A | | 9/1986 | Stricker et al. |
| 4,631,433 | A | | 12/1986 | Stokes |
| 4,632,642 | A | | 12/1986 | Meister, III et al. |
| 4,634,908 | A | | 1/1987 | Sturm |
| 4,677,335 | A | | 6/1987 | Ueda et al. |
| 4,684,330 | A | | 8/1987 | Andersson et al. |
| 4,733,976 | A | * | 3/1988 | Henriksson et al. ..... 384/97 |
| 4,793,774 | A | | 12/1988 | Bradt et al. |
| 4,822,241 | A | | 4/1989 | Jarvis et al. |
| 4,999,020 | A | | 3/1991 | Stocco et al. |
| 5,040,943 | A | | 8/1991 | Dwyer et al. |
| 5,174,318 | A | | 12/1992 | Dingler et al. |
| 5,215,443 | A | | 6/1993 | Hani et al. |
| 5,249,402 | A | | 10/1993 | Crick et al. |
| 5,306,121 | A | | 4/1994 | Heflin et al. |
| 5,494,414 | A | | 2/1996 | Steinhart et al. |
| 5,530,304 | A | | 6/1996 | Mirumachi et al. |
| 5,567,130 | A | | 10/1996 | Kvinge et al. |
| 5,615,999 | A | | 4/1997 | Sukup |
| 5,653,584 | A | | 8/1997 | Mazzucato et al. |
| 5,716,200 | A | | 2/1998 | Mirumachi et al. |
| 5,747,903 | A | | 5/1998 | Klingler |
| 5,793,134 | A | * | 8/1998 | Worm ..... 310/82 |
| 5,794,515 | A | | 8/1998 | Bethke |
| 5,803,714 | A | | 9/1998 | Tominaga et al. |
| 5,975,863 | A | | 11/1999 | Mazzucato |
| 5,980,220 | A | | 11/1999 | Mazzucato et al. |
| 6,112,641 | A | | 9/2000 | Magri et al. |
| D528,982 | S | | 9/2006 | Reverberi |
| D532,793 | S | | 11/2006 | Reverberi |
| D536,005 | S | | 1/2007 | Reverberi |
| 2002/0006340 | A1 | * | 1/2002 | Nathan ..... 417/269 |
| 2005/0135953 | A1 | | 6/2005 | Reverberi et al. |
| 2006/0024173 | A1 | | 2/2006 | Rocchi et al. |

FOREIGN PATENT DOCUMENTS

| | | | |
|---|---|---|---|
| DE | 2146815 | | 6/1972 |
| DE | 32 08 552 | C1 | 4/1983 |
| DE | 85 14 497.5 | U1 | 8/1985 |
| DE | 43 38 896 | | 6/1994 |
| DE | 89 16 241 | U1 | 2/1996 |
| DE | 196 35 335 | C1 | 8/1997 |
| EP | 0 503 298 | A1 | 9/1992 |
| FR | 979 507 | | 4/1951 |
| GB | 646 371 | | 11/1950 |
| GB | 750 735 | | 6/1956 |
| GB | 957 296 | | 5/1964 |
| GB | 1 333 540 | | 10/1973 |

OTHER PUBLICATIONS

European Search Report dated Dec. 28, 2005.

* cited by examiner 3
22
2
21
61
62
1
63
40
44
43
4
6
65
66
60
71
91
81
82
10
5
9
8
71
7
66
60
41
65
64
33
6

PUMP BODY WITH PLUNGER PISTONS

FIELD

The present invention refers to high-pressure liquid pumps of the type used in water cleaners.

BACKGROUND

These pumps, generally known as plunger pistons, have a head in which the ducts are formed and in which the intake and delivery valves are situated, a body separate from said head in which the actuation means of one or more pistons are situated, and means for fixing said pump body to the drive motor body.

More specifically, the drive shaft of the motor inserts into the pump body to lock torsionally to the hollow tang of the hub of a rotating inclined plate on the periphery of which the ends of the pistons slide.

In order to avoid friction, the ends of the pistons are rested on a rotating ring, with interposition of rollers, on the inclined plate.

The hollow tang of the hub is in turn supported by the pump body through a rolling ball bearing.

In known pumps the pump body is closed, on the motor side, by a shaped cover that carries the attachment arms to the body of the motor and acts as a seat for the bearing that supports the hollow tang of the hub of the inclined plate, as well as for an oil sealing gasket.

The cover is then connected to the pump body through peripheral bolts.

The known solution has a series of drawbacks that lie both in the constructive complication and in the difficulty of assembly of the pump.

SUMMARY

The purpose of the present patent is to overcome said drawbacks in a simple, cost-effective and reliable solution.

The purpose is accomplished by the solution defined in the independent claim.

The dependent claims illustrate advantageous constructive details.

Basically, the purpose is accomplished by a pump body that directly carries said attachment and support means of the body of the drive motor, which makes it possible to eliminate the cover.

BRIEF DESCRIPTION OF THE DRAWINGS

The advantages and the constructive and functional characteristics of the finding shall become clear from the following detailed description, which with the help of the figure of the attached table illustrates a preferred embodiment given as a non-limiting example.

DETAILED DESCRIPTION

Figure 1:
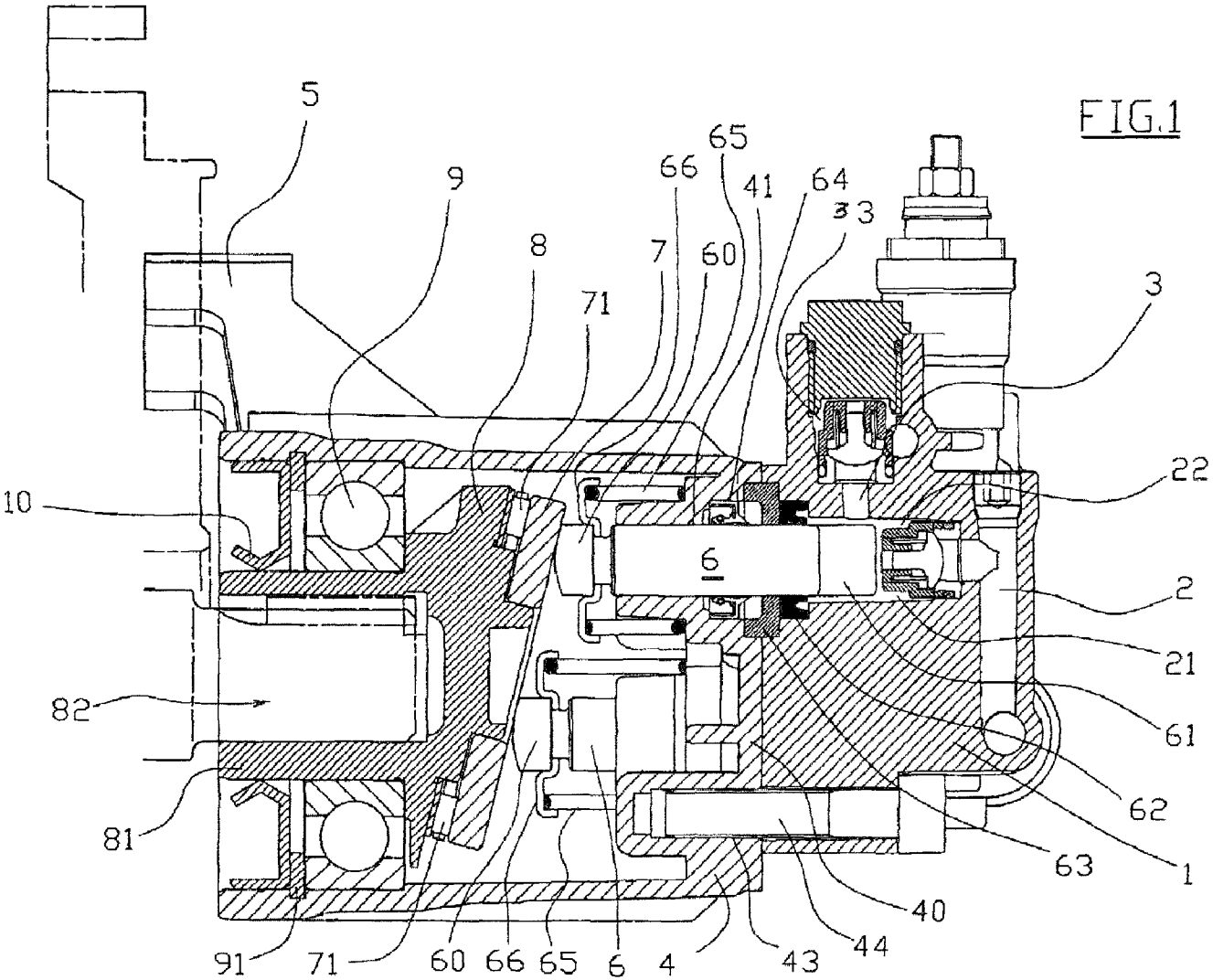
FIG. 1 is an axial section view of the pump.

In FIG. 1, it is possible to see the head 1 of the pump in which the intake and delivery ducts 2, 3 of the liquid, as well as the seats 22 and 33 of the respective intake and delivery valves, per se known, are formed.

The pump body 4 is cup-shaped, and directly carries attachment and support means of the body of the drive motor, for example of the endothermal or combustion type, not illustrated.

In the example, said attachment and support means are in the form of three brackets 5 arranged close to the open end of the body 4 spaced apart by 120°.

The bottom wall 40 of the body 4 has the sliding seats 41 for the pistons 6, these being seats that extend inside the head 1 for the portion 61 received in the recesses 21 of the head 1.

The bottom wall 40 also comprises peripheral seats 43 for receiving bolts 44 that fix the head 1 to the body 4.

Each piston seat 6 comprises a sealing gasket 62 received in the recess 21 of the head 1, a cup-shaped lid 63 received in the head 1, and an oil seal 64 received in the pump body 4 adjacent to said lid 63.

The ends 60 of the pistons 6 that extend inside the body 4 rest upon the ring 7 rotating freely on the inclined plate 8 with interposition of the rollers 71.

The springs 65 and the platelets 66 keep the pistons in contact with the ring 7.

The rotating plate 8 has a hollow tang 81 that is coupled with the pump body 4 by a bearing kept in position by an elastic ring 91 that axially locks the bearing 9 with respect to the pump body 4.

A gasket 10 isolates the inside of the body 4 from the outside.

The recess 82 of the tang 81 receives the shaft of the electric motor, not illustrated, with interposition of a key.

The aforementioned configuration also allows a somewhat advantageous assembly procedure.

In addition to the valves, the gaskets 62 and the lids 63 are also pre-assembled in the head 1.

The pump body 4, on the other hand, receives, in order starting from the left in the figures, the pistons 6, the springs 65 and the relative platelets 66, the group comprising the inclined plate 8 with ring 7, the bearing 9 and the elastic ring 91 and the gasket 10.

The head 1 is fixed, with prior arrangement of the oil seal 64, to the body 4 through the bolts 44 and everything is ready to be fixed to the body of the electric motor through the brackets 5.

As can be appreciated from what has been described, the pump body with plunger pistons according to the present invention allows the requirements to be satisfied and the drawbacks mentioned in the introductory part of the present description with reference to the prior art to be overcome.

Indeed, the pump body with plunger pistons of the present invention is extremely simple to make and has substantially less difficulty of assembly with respect to pump bodies of the prior art.

Of course, a man skilled in the art can bring numerous modifications and variants to the pump body with plunger pistons described above in order to satisfy contingent and specific requirements, all of which are in any case covered by the scope of protection of the invention, as defined by the following claims.

The invention claimed is:

1. Pump with at least one plunger piston (6) comprising:

a head (1) in which are formed intake and delivery ducts (2, 3) and respective intake and delivery valves, a cup shaped pump body (4) formed in one piece having a bottom wall and a completely open end opposite the bottom wall associated with said head (1), a drive means (8) for driving said at least one plunger piston (6) and received in the pump body through said completely open end, wherein the pump body comprises attachment and support means (5) for attaching said pump body (4) to a body containing a drive motor for the pump, wherein said bottom wall (40) comprises at least one seat (41) for the sliding of said at least one plunger piston (6), wherein said open end of said pump body faces towards said motor, and wherein said pump body has an inner peripheral dimension that is transverse to a longitudinal axis of said drive means and is at a maximum at the open end.

2. Pump according to claim 1, wherein said drive means comprise a rotating inclined plate (8) having a hollow tang (81).

3. Pump according to claim 2, wherein a bearing (9) is arranged between said hollow tang (81) and said pump body (4).

4. Pump according to claim 3, wherein said bearing (9) is kept in position by an elastic ring (91) that axially locks the bearing (9) with respect to the pump body (4).

5. Pump according to claim 3, wherein said pump body (4) is isolated from the outside through a gasket (10) arranged between the pump body (4) and the hollow tang (81).

6. Pump according to claim 1, wherein said attachment and support means comprise a plurality of brackets (5) cantilevered from said pump body (4).

7. A pump having at least one plunger piston comprising:

a pump head;

intake and delivery ducts and respective intake and delivery valves formed in the head;

a one piece cup-shaped pump body associated with said pump head, said pump body comprising a bottom wall and a completely open end opposite said bottom wall;

drive means, contained within said pump body and connected to drive said at least one plunger piston;

attachment and support means connected to said pump body for attaching said pump body to a body containing a drive motor for the pump; and at least one seat formed in the bottom wall of said one piece cup-shaped pump body, in which said at least one plunger piston slides, wherein said pump body directly carries said attachment and support means and said completely open end opposite to said bottom wall opens towards said motor to receive said drive means, and wherein said pump body has an inner peripheral dimension that is transverse to a longitudinal axis of said drive means and is at a maximum at the open end.

* * * * *

UNITED STATES PATENT AND TRADEMARK OFFICE

CERTIFICATE OF CORRECTION

PATENT NO. : 7,658,597 B2
APPLICATION NO. : 11/180633
DATED : February 9, 2010
INVENTOR(S) : Rocchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 603 days.

Signed and Sealed this

Thirtieth Day of November, 2010

David J. Kappos

David J. Kappos
*Director of the United States Patent and Trademark Office*